US009580663B2

(12) United States Patent
Low et al.

(10) Patent No.: US 9,580,663 B2
(45) Date of Patent: Feb. 28, 2017

(54) PROCESS FOR HYDROCRACKING A HYDROCARBON FEEDSTOCK

(75) Inventors: Gordon Gongngai Low, Santa Ana, CA (US); Michael Glenn Hunter, Orange, CA (US)

(73) Assignee: Haldor Topsoe A/S, Lyngby (DK)

( * ) Notice: Subject to any disclaimer, the term of this patent is extended or adjusted under 35 U.S.C. 154(b) by 365 days.

(21) Appl. No.: 13/880,356

(22) PCT Filed: Oct. 5, 2011

(86) PCT No.: PCT/EP2011/004949

§ 371 (c)(1),
(2), (4) Date: Apr. 18, 2013

(87) PCT Pub. No.: WO2012/052116

PCT Pub. Date: Apr. 26, 2012

(65) Prior Publication Data

US 2013/0220885 A1 Aug. 29, 2013

Related U.S. Application Data

(60) Provisional application No. 61/421,058, filed on Dec. 8, 2010, provisional application No. 61/436,873, filed on Jan. 27, 2011.

(30) Foreign Application Priority Data

Oct. 20, 2010 (WO) ..... PCT/EP2010/006411

(51) Int. Cl.
*C10G 67/06* (2006.01)
*C10G 47/36* (2006.01)
(Continued)

(52) U.S. Cl.
CPC ..... *C10G 47/36* (2013.01); *C10G 7/00* (2013.01); *C10G 47/00* (2013.01); *C10G 47/02* (2013.01);
(Continued)

(58) Field of Classification Search
CPC ..... C10G 2300/301; C10G 2300/4081; C10G 2300/807; C10G 2400/02; C10G 2400/04;
(Continued)

(56) References Cited

U.S. PATENT DOCUMENTS 4,961,839 A 10/1990 Stine et al.
5,120,427 A 6/1992 Stine et al.
(Continued)

FOREIGN PATENT DOCUMENTS

WO WO 2012/052042 A1 4/2012

*Primary Examiner* — Renee Robinson
*Assistant Examiner* — Derek Mueller
(74) *Attorney, Agent, or Firm* — Blank Rome LLP

(57) ABSTRACT

A hydrocracking process by the steps of: (a) providing a mixture comprising hydrocarbonaceous feedstock and hydrogen; (b) obtaining a hydrocracked effluent; (c) separating the hydrocracked effluent into a first vapor portion and a first liquid portion; (d) heating the first liquid portion to form a vapourised first liquid portion; (e) feeding the vaporised first liquid portion to a fractionation section producing individual product fractions including a heavy bottom fraction; (f) withdrawing from the fractionation section the heavy bottom fraction; (g) splitting the heavy bottom fraction in a stream for stripping and a heavy bottom fraction recycle stream; (h) stripping the stream for stripping, with a stripping medium, in a counter current stripping column to form an overhead vapor and a stripped liquid; (i) feeding the overhead vapor to the fractionation section, to a recycle stream or to a position upstream the fractionation section.

13 Claims, 4 Drawing Sheets

(51) Int. Cl.
*C10G 7/00* (2006.01)
*C10G 47/00* (2006.01)
*C10G 47/02* (2006.01)

(52) U.S. Cl.
CPC ..... *C10G 67/06* (2013.01); *C10G 2300/301* (2013.01); *C10G 2300/4081* (2013.01); *C10G 2300/807* (2013.01); *C10G 2400/02* (2013.01); *C10G 2400/04* (2013.01); *C10G 2400/08* (2013.01)

(58) Field of Classification Search
CPC .... C10G 2400/08; C10G 47/00; C10G 47/02; C10G 47/36; C10G 67/06; C10G 7/00
See application file for complete search history.

(56) References Cited

U.S. PATENT DOCUMENTS

| | | | |
|---|---|---|---|
| 6,190,535 | B1 | 2/2001 | Kalnes et al. |
| 6,361,683 | B1 | 3/2002 | Kalnes |
| 6,858,128 | B1 | 2/2005 | Hoehn et al. |
| 2006/0213809 | A1 | 9/2006 | Barthelet et al. |

PROCESS FOR HYDROCRACKING A HYDROCARBON FEEDSTOCK

The invention relates to a process for hydrocracking a hydrocarbon feedstock to obtain more valuable lower boiling products such as liquefied petroleum gas (LPG), naphtha, kerosene, and diesel. In particular, the invention concerns a process whereby heavy polynuclear aromatic compounds are concentrated in a portion of the unconverted oil so they can be removed, resulting in increased conversion and yield of products.

The complete conversion of petroleum or synthetic heavy gas oils to distillate products such as gasoline, jet and diesel fuel in a hydrocracker is practically limited by the formation of heavy polynuclear aromatic (HPNA) compounds. These compounds, formed by undesired side reactions, are stable and virtually impossible to hydrocrack. HPNA are fused polycyclic aromatic compounds having 7+ rings for example coronenes $C_{24}H_{12}$, benzocoronenes $C_{28}H_{14}$, dibenzocoronenes $C_{32}H_{16}$ and ovalenes $C_{32}H_{14}$.

HPNA with 7+ aromatic rings are by-products of hydrocracking reactions that can potentially cause significant problems in hydrocracking units. When the solubility limit for the HPNA is exceeded, solids form in transfer lines, valves and on heat exchanger surfaces. Furthermore the HPNA can contribute to catalyst deactivation by reversible inhibition and coke formation. HPNA problems particularly occur when processing heavy feedstocks with high distillation endpoints and more aromatic cracked stocks in high conversion recycle units.

Consequently, HPNA build up to high levels in the recycle streams normally employed in high conversion processes, resulting in fouling of the catalysts and equipment.

The conventional solution to this problem is to remove a portion of the recycle oil stream as an unconverted oil stream to purge the HPNA compounds from the system, effectively balancing the HPNA purge rate with the rate of their formation by reactions. This approach limits the total conversion level achievable in the hydrocracker.

In a conventional high conversion hydrocracking process, a hydrocarbonaceous heavy gas oil feedstock is combined with a hydrogen-rich gas and reacted over catalyst to obtain a hydrocracked effluent comprising less dense, lower molecular weight products. The hydrocracked effluent from the reactor is condensed and separated in a separation zone into a liquid portion comprising primarily hydrocarbons and a vapour portion comprising primarily un-reacted hydrogen. The vapour from this separation may be combined with hydrogen makeup to account for hydrogen consumed by reaction and may then be compressed and re-circulated back to the reactor vessel. The first liquid portion from the separation zone is then directed to a fractionation section where the lighter products are distilled from the heavy unconverted products in a fractionation section e.g. a fractionation tower or a series of fractionation towers. Heat is normally input to this recovery operation in order to provide the necessary energy for separation.

The conventional approach to controlling the build-up of HPNA compounds in the recycle oil is to withdraw a purge of recycle oil product from the unit as unconverted oil. The purge rate may be adjusted so as to balance the rejection of HPNA with the net production. Such a purge essentially reduces the achievable total conversion level by hydrocracking to less than 100 percent. Depending on the feed quality and process conditions the purge rate can be from one or two percent up to as high as 10 percent of the fresh feed rate. The yield of valuable distillate products are correspondingly reduced at substantial economic loss to the refiner.

U.S. Pat. No. 6,361,683 discloses a hydrocracking process whereby the hydrocracked effluent is hydrogen stripped in a stripping zone to produce a gaseous hydrocarbonaceous stream which is passed through a post-treatment hydrogenation zone to saturate aromatic compounds. The fractionation zone is associated with a stripping zone which is fed with stripped hydrocarbonaceous liquid obtained by stripping the hydrocracked effluent. Stripping to remove HPNA is also considered.

U.S. Pat. No. 6,858,128 discloses a hydrocracking process which utilises a fractionation zone having a bottom section with a dividing wall to include sections suitable for steam stripping to concentrate HPNA.

U.S. Pat. Nos. 4,961,839 and 5,120,427 disclose a hydrocracking process in which all of the bottoms fraction is fed to a stripping column, provided as a stub column at the bottom of the fractionation zone. The fractionation zone is fed by a vapourised stream, for recovering a majority of light hydrocarbons, while enabling a purge of a liquid net bottoms stream rich in HPNA. The patent employs a high degree of vapourisation of the feed to the fractionation in order to minimize the purged stream and to ensure that only a PNA free fraction is recycled, but this high degree of vapourisation is associated with an undesired consumption of energy.

There is substantial economic incentive to maximize the conversion of the heavy feed and a key feature of most such processes is the recycle of unconverted oil back to the reaction system thereby controlling the cracking severity and improving the selectivity of the hydrocracking reactions to more desirable end products such as gasoline, jet fuel and diesel fuel. All known hydrocracking processes and catalysts are, however, subject to undesirable side reactions leading to the formation of heavy poly-nuclear aromatic (HPNA) compounds, which accumulate in the unconverted oil, recycle stream. These compounds are virtually impossible to convert by hydrocracking reactions and show a strong tendency to build up to high concentration levels in the recycle oil stream. As the concentration builds up, the performance of the reactor system is continuously degraded leading to uneconomic conditions.

It is an objective of the invention to provide a hydrocracking process whereby conversion of the heaviest and highest molecular weight materials into products is increased, resulting in reduced net yield of unconverted oil.

It is a further objective of the hydrocracking process to minimize the need for purge by concentrating the HPNA compounds in a portion of the unconverted oil stream.

These objectives are achieved by a hydrocracking process comprising the steps of:

(a) combining a hydrocarbonaceous feedstock and a heavy bottom fraction recycle stream with a hydrogen-rich gas to obtain a mixture comprising hydrocarbonaceous feedstock and hydrogen;
(b) catalytically hydrocracking the mixture comprising hydrocarbonaceous feedstock and hydrogen in a hydrocracking zone to obtain a hydrocracked effluent;
(c) separating the hydrocracked effluent into a first vapour portion and a first liquid portion in a separation zone;
(d) heating the first liquid portion to form a substantially vapourised first liquid portion;
(e) feeding the vapourised first liquid portion to a fractionation section producing individual product fractions including a heavy bottom fraction comprising unconverted oil at the bottom zone of the fractionation section;

(f) withdrawing from the fractionation section the heavy bottom fraction;

(g) splitting the heavy bottom fraction into a stream for stripping and a heavy bottom fraction recycle stream;

(h) stripping the stream for stripping, with a stripping medium, in a counter current stripping column to form an overhead vapour and a stripped liquid;

(i) feeding the overhead vapour to the fractionation section, to a recycle stream or to a position upstream the fractionation section; and (j) removing at least a part of the stripped liquid from the counter current stripping column as a net purge of unconverted oil.

In one embodiment the vapourised first liquid portion is at least 50%, preferably at least 75%, even more preferably at least 85%, and most preferably at least 90% vapourised, and at most 95%, preferably at most 90%, even more preferably at most 85%, and most preferably at most 75% vapourised with the associated effects of increasing separation of HPNA and product in the fractionation zone with increasing degree of vapourisation, and increasing energy efficiency with decreasing vapourisation, as any recycled vapourised fractions will undergo an additional phase change prior to recycle.

In one embodiment a part of the stripped liquid is recycled, combined with the stream for stripping and directed to an inlet of the counter current stripping column, resulting in an increased concentration of HPNA in the net purge.

In one embodiment the recycled portion of the stripped liquid and/or the stream for stripping is heated by heat exchange with the heavy bottom fraction, with the benefit of increased recuperation of waste heat, and a better flow and separation of the liquid in the stripper.

In a further embodiment, the stream for stripping is heated prior to the stripping process to raise its temperature above its bubble point such as above 300°, preferably above 320° C. and most preferably above 330° C. which has the effect of concentrating the HPNA even further, by facilitating the evaporation of other constituents.

In a further embodiment thermal energy is transferred from the heavy bottom fraction to the stripping medium by heat exchange, which allows heat exchange on streams which have not been concentrated further into heavy unconverted oil by stripping.

In a further embodiment, the stripping medium is steam preferably medium pressure steam having a pressure between 1 and 20 barg, more preferably between 3.5 and 10 barg and most preferably between 3.5 and 6 barg.

In an embodiment the first vapour portion comprises lighter low molecular weight products and unconverted hydrogen.

Another embodiment provides as the heavy bottom fraction the highest normal boiling fraction from the fractionation section, comprising hydrocarbonaceous material In one embodiment improved separation is obtained in the counter current stripping column as it comprises multiple equilibrium stages in the form of trays or packing material.

In a further embodiment a part of the heavy bottom fraction is directed into a stream of heavy bottom fraction for recycling and combined with the hydrocarbonaceous feedstock for being input to the hydrocracking zone, to provide hydrocracking of unconverted oil.

In an embodiment the flow rate of the stream for stripping is controlled by a flow control unit according to a desired flow rate of the net purge of unconverted oil, such that the net purge flow may be optimised.

The hydrocarbonaceous feedstock may be hydrotreated prior to hydrocracking.

In an embodiment some or all of the energy for heating of the stream for stripping is provided from heat exchange with one or more streams from the hydrocracking process e.g. a reactor effluent, or from heat exchange with an external source of heating medium such as high pressure steam, hot flue gas from a fired heater, or by electrical heating.

An embodiment involves a process wherein the stripped liquid comprises heavy polynuclear aromatic compounds in an amount larger than the amount comprised in the heavy bottom fraction withdrawn from the fractionation column, thus reducing the share of unconverted oil in the net purge stream.

In a further embodiment stripping medium output from the stripping unit may be added to the fractionation section, resulting in a saving of stripping medium consumption.

In a further embodiment the process further comprises the step of recycling some of the stripped liquid from the counter current stripping column and mixing it with the stream for stripping, for feeding it to the counter current stripping column, with the associated effect of providing an even higher concentration of HPNA in the unconverted oil. In this case it may be necessary to add further heat to the counter current stripping process, to ensure the liquid is above its bubble point temperature during stripping.

In a further embodiment HPNA is extracted from the net purge by adsorption on an adsorbent, to allow the net purge to be recycled to the process, with the benefit of increased yield.

FIG. 1 illustrates an embodiment of the process according to the invention in which flow control is employed on the stream for stripping and a part of the heavy bottom fraction is recycled.

The disclosed process utilizes specific process steps to reduce the net purge of unconverted oil from a hydrocracker. This reduction may be accomplished by taking the bottom fraction stream from the bottom of the product fractionation section such as a fractionation column, heating it substantially above its bubble point and then stripping with steam in a counter-current column with fractionating trays or packing material. The stripping step at elevated temperature vapourises a substantial amount of the bottom fraction stream compared to simply stripping the heavy bottom fraction at its bubble point without heating. The overhead vapour of the heavy bottom fraction may be returned to the fractionation section e.g. at the bottom. The stripped part of the heavy bottom fraction remains a liquid and is collected in the bottom of the stripping tower. This stream is having a substantially higher boiling point than the original unconverted oil and therefore HPNA is concentrated in the heavier bottoms liquid, which may then be removed as net purge from the hydrocracker.

The higher concentration of HPNA in the stripped liquid allows the removal of the desired amount of HPNA at lower purge rate in a net purge stream. The reduced net purge rate results in higher total conversion in the hydrocracker together with increased yields of valuable distillate products.

The concentration of HPNA in the net purge may even be further increased by recycling a part of the stripped liquid of the heavy bottom fraction to an inlet of the stripper. The recycled stream may be heated by heat exchange with e.g. the heavy bottom fraction to optimise the heat consumption of the process.

This disclosure provides a simple process for concentrating the HPNA compounds in a portion of the unconverted oil stream and thereby minimizing the required purge flow rate.

The required purge flow rate is reduced substantially leading to higher conversion and better yields of final products.

The disclosure utilizes specific process steps to reduce the required purge of unconverted oil from the hydrocracker substantially, such as at least 25 percent and preferably by 50 percent or more. This reduction is accomplished by withdrawing a bottom fraction comprising unconverted oil in a first purge stream from the fractionation section, heating it substantially above its bubble point and then stripping with steam in a counter-current column with fractionating trays or packing material. The stripping step vapourises a substantial amount, such as at least 25 percent and preferably 50 percent or more of the bottom fraction stream returning this overhead vapour to the bottom of the fractionation section. The remainder of the bottom fraction stream remains as a stripped liquid and is collected in the bottom of the stripping tower. This liquid is substantially higher boiling than the original unconverted oil and because of the very high normal boiling point of the HPNA compounds, the physical separation concentrates the HPNA in the heavier bottoms liquid, which is then removed as net purge from the hydrocracker. The higher concentration of HPNA in the stripped liquid allows the removal of the required HPNA at lower purge flow rate. The reduced purge rate results in higher total conversion in the hydrocracker together with increased yields of valuable distillate products.

By providing the stripping of the unconverted oil in a separate process step, multiple advantageous effects are obtained. An independent temperature and flow control is made possible, which allows an optimisation of the stripping conditions, and counter current flow is enabled, which has a better stripping efficiency compared to co-current flow.

DETAILED DESCRIPTION OF THE PREFERRED EMBODIMENTS

Figure 1:
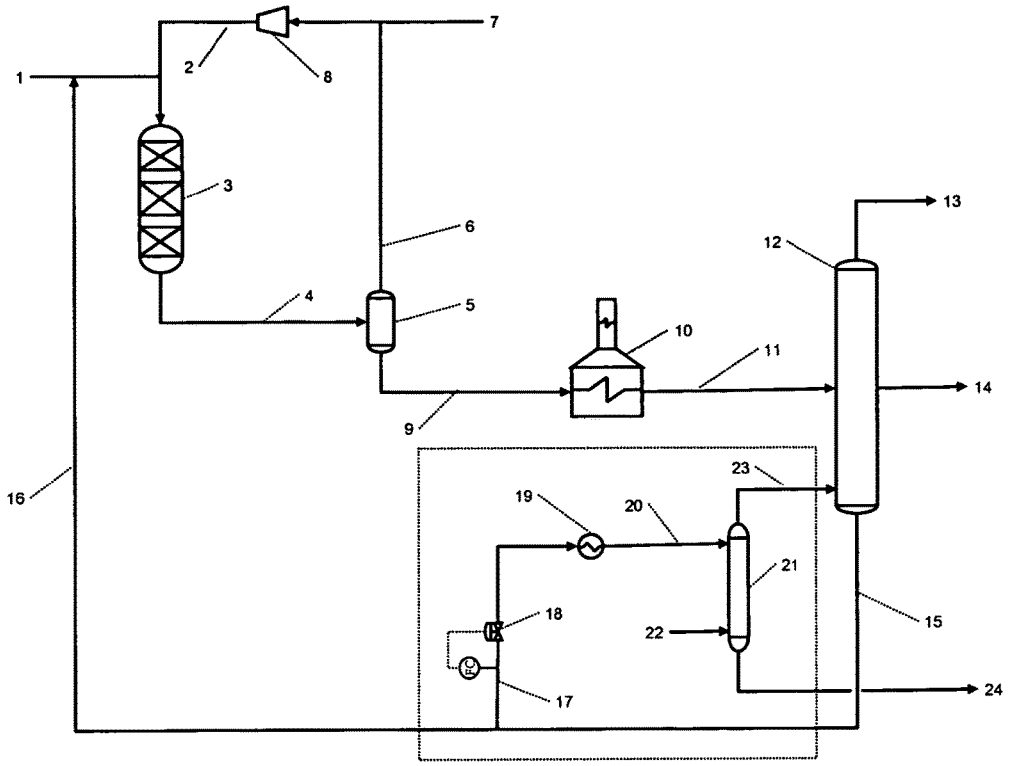
FIG. 1 illustrates the system for carrying out the process of the present invention.

Reference is made to FIG. 1, which illustrates schematically the process flows and equipment configuration as embodied in this invention.

Fresh feedstock consisting of a hydrocarbonaceous feed, such as petroleum or synthetic heavy gas oils of mineral or biological origin 1 is combined with hydrogen rich gas 2 and an optional recycle stream of unconverted product 16 and fed to a hydrocracking zone 3 consisting of one or more catalysts contained in one or more reaction vessels. The catalysts promote the hydroconversion of the hydrocarbonaceous feedstock, which may include hydrogenation to a lighter hydrocracked effluent. The hydrocracking effluent, comprising hydrocarbon products together with excess hydrogen not consumed by the reaction exits the hydrocracking zone 4 and enters a separation zone 5 consisting of one or more vessels that perform separation into a first vapour portion and a first liquid portion. The first vapour portion 6 from the separation zone may be combined with makeup hydrogen 7 to replenish the hydrogen consumed by reaction. The hydrogen rich stream may then be compressed in compressor 8 for recycle back to the hydrocracking zone.

The first liquid portion 9 from the separation step passes to a process heater 10 supplying energy for substantially vapourising the fluid 11 before feeding the product fractionation section 12. The fractionation section consists of one or more towers or columns with multiple equilibrium stages in the form of trays or packing material which may be operated in counter-current flow. The towers are normally stripped with steam or reboiled to facilitate vapourisation of the products. The fractionation section performs the separation of individual product and intermediate fractions 13, 14 such as gasoline, jet fuel and diesel fuel according to differences in their normal boiling points. At the bottom zone of the fractionation section the heaviest bottom fraction, i.e. unconverted oil 15, may be collected and withdrawn as an unconverted oil product or returned to the reactor in line 16 as a recycle oil stream for further conversion.

The aim of a hydrocracking process is to convert all or as much of the heaviest and highest molecular weight materials into products resulting in no or a minimal net yield of unconverted oil 15. However, a first purge of unconverted oil or heavy bottom fraction 17 must be withdrawn from the hydrocracker possibly on flow control 18 in order to avoid a build-up of HPNA within the reaction system. In a heavy bottom fraction stripping system, the heavy bottom fraction stream for stripping is routed to a process heater 19 such that the temperature of this stream for stripping 20 is raised substantially above the bubble point of the stream for stripping and of the temperature of the fractionation section bottom. This heated stream for stripping is then fed to the top of a counter-current stripping tower 21 consisting of multiple equilibrium stages in the form of trays or packing material. Steam is added to the bottom of the stripping tower 22 to facilitate vapourisation of the unconverted oil. The overhead vapour from the top of the stripping tower 23 is routed to the bottom of the fractionating column 12. The stripped liquid portion of the stream for stripping which is not vapourised in the stripper flows to the bottom of the tower and is then removed from the hydrocracker as a net purge of unconverted oil 24.

The operating conditions in the heavy bottom fraction stripping system are established such that the net purge of unconverted oil 24 from the bottom of the stripper is substantially less than the heavy bottom fraction, i.e. unconverted oil 17 removed from the heavy bottom fraction stream for stripping, while sufficiently removing the undesired HPNA.

Figure 2:
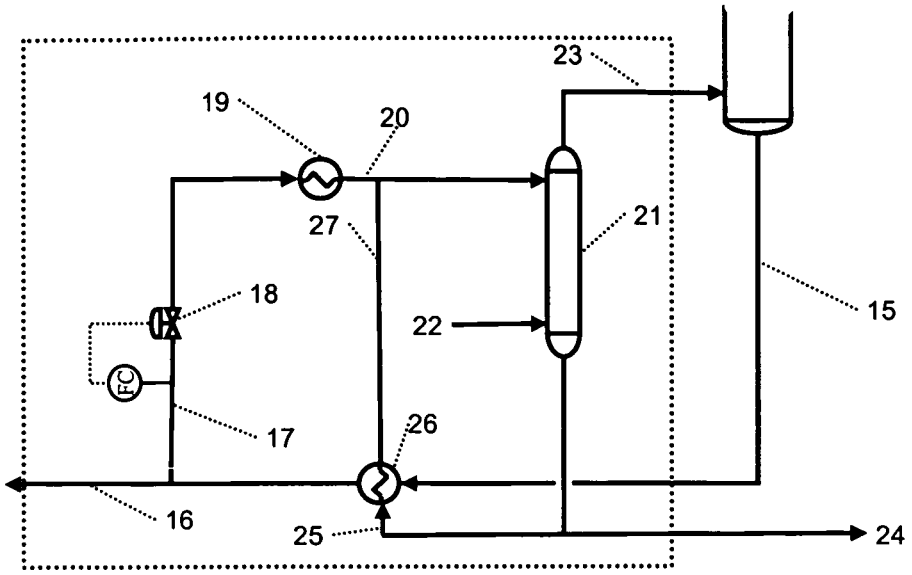
FIG. 2 shows the flow scheme at the outlet of the fractionation section.

Reference is made to FIG. 2, which illustrates schematically the process flows and equipment configuration in a detail of a preferred embodiment, employing the same reference numbers as FIG. 1 for similar elements in similar function.

FIG. 2 shows the flow scheme at the outlet of the fractionation section. The earlier elements of the process correspond to those of FIG. 1 as described above.

As mentioned the aim of a hydrocracking process is to convert all or as much of the heaviest and highest molecular weight materials into products resulting in no or a minimal net yield of unconverted oil 15. However, a first purge of unconverted oil or heavy bottom fraction 17 must be withdrawn from the hydrocracker possibly on flow control 18 in order to avoid a build-up of HPNA within the reaction system. In a heavy bottom fraction stripping system according to the present disclosure, the withdrawn heavy bottom fraction stream is directed as a stream for stripping, and may be routed to a process heater 19 such that the temperature of the stream for stripping 20 is raised substantially above the bubble point of the heavy bottom fraction stream for stripping and of the temperature of the fractionation section bottom. This heated stream for stripping is then fed to the top of a counter-current stripping tower 21 consisting of multiple equilibrium stages in the form of trays or packing material. Steam is added to the bottom of the stripping tower 22 to facilitate vapourisation of the unconverted oil. The overhead vapour from the top of the stripping tower 23 is routed to the bottom of the fractionation section 12. The stripped liquid from the stream for stripping which is not vapourised in the stripper will flow to the bottom of the tower. A part of this stripped liquid is removed from the hydrocracker as a net purge (a necessary purge) of unconverted oil 24, and another part 25 is recycled to an inlet of the stripping tower 22, which may either be the same or one different from the inlet through which the stream for stripping from the fractionation section is fed. In Fig. Two, the recycled liquid 27 is heated by heat exchange 26 with the heavy bottom fraction 15 of the fractionation section.

The operating conditions in the heavy bottom fraction stripping system are established such that the net purge of unconverted oil 24 from the bottom of the stripper is substantially less than the heavy bottom fraction, i.e. unconverted oil 17 removed from the heavy bottom fraction stream for stripping, while sufficiently removing the undesired HPNA.

Figure 3:
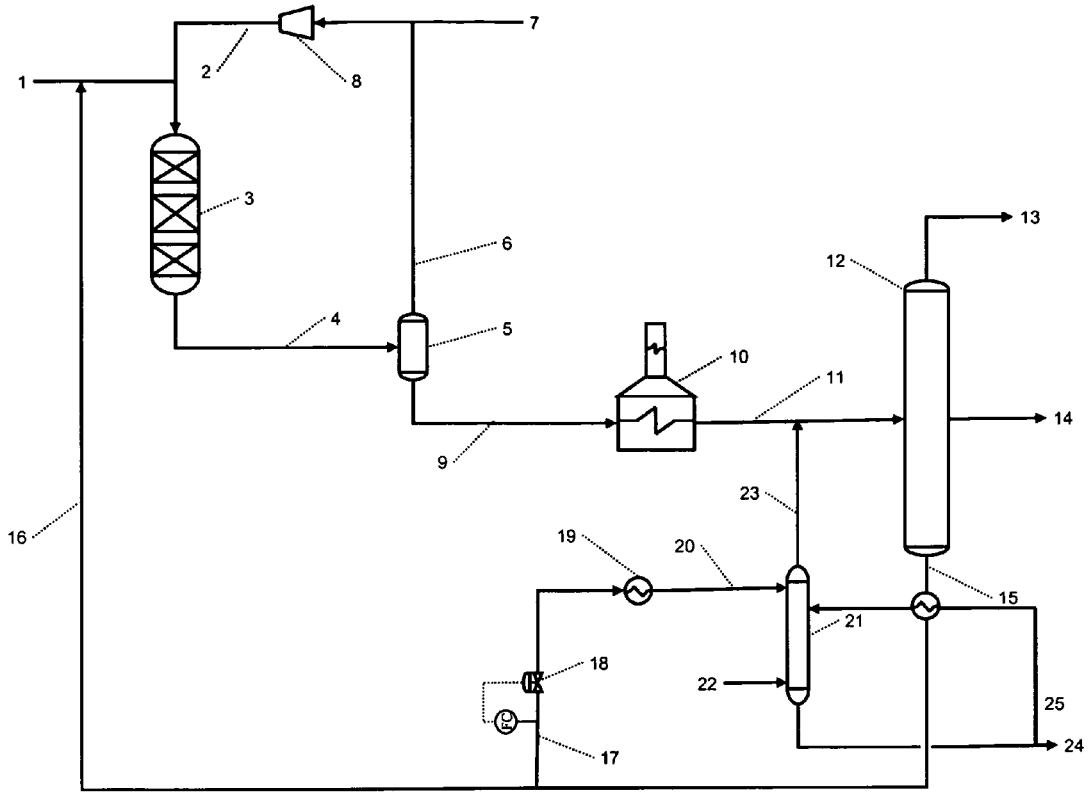
FIG. 3 shows an alternate embodiment of the invention in which a portion of the stripped liquid is recycled and fed to the top of the stripper after being heated by heat exchange with the heavy bottom fraction steam.

In an alternate embodiment of the invention illustrated in FIG. 3, a portion 25 of the stripped liquid 24 is recycled and fed to the top of the stripper 21 after being heated by heat exchange with the heavy bottom fraction stream 24. Heating of this recycled stripped liquid is required because of the temperature drop caused by contacting with the large volume of stripping steam. Substantial thermal energy can be supplied to the stripped liquid and unconverted oil in this manner without raising the temperature excessively above the feed temperature to the stripper. This has the benefit of reducing the thermal degradation of the unconverted oil compared to feeding the heavy bottom fraction to the stripper at a higher temperature. Further in the embodiment of FIG. 3 the overhead vapour 23 is directed to a position upstream the fractionation section 12 and not directly to the fractionation section, which may require less reconfiguration in the case of retrofitting an existing unit, compared to the embodiments where the overhead vapour is directed directly to the fractionation section 12.

Figure 4:
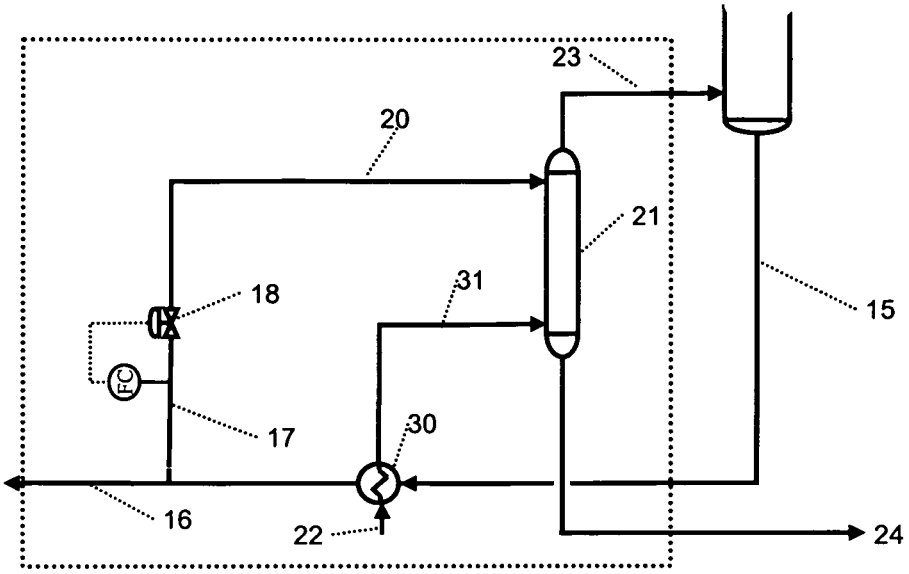
FIG. 4 illustrates an embodiment in which the heat of the heavy bottom fraction is recovered by heat exchange, providing superheated steam which is fed to the stripper.

Under certain process conditions, it may be beneficial to avoid directing the high boiling recycled stripped liquid to a heat exchanger. Therefore, under such process conditions, it may be preferred to use the embodiment of FIG. 4, in which the heat of the heavy bottom fraction 15 is recovered by heat exchange in heat exchanger 30 with a steam line 22, providing superheated steam 31 which is fed to the stripper 21. A sufficient amount of low pressure steam of 170° C. may be heated to superheated steam at 330° C. in such a situation, while reducing the temperature of the heavy bottom fraction by only about 5° C.

Dependent on the configuration of the hydrotreater and fractionation section, alternative configurations of the stripping tower exist.

In alternative cases where the fractionation section 12 is a vacuum distillation column, or is a main fractionator with a fired reboiler, such that it is not operated with steam, the HPNA concentrator will not be configured to return a steam output to the fractionator. In these cases the HPNA concentrator may be configured with a condenser for condensing the steam and the overhead hydrocarbons. The overhead water from the steam may be reused as wash water, and the overhead hydrocarbons may be fed to the fractionator, to the recycle stream or a position upstream the fractionator, such as a feed surge drum.

In such alternative embodiments the heavy bottom fraction from the fractionation column may still be used to preheat the recycled stripped liquid stream.

The pressure conditions of the stripper would be configured accordingly, e.g. to operate under vacuum or low pressure if required, by being attached to the vacuum system and using only a small amount of low pressure steam to strip the unconverted oil.

In alternative embodiments alternatives to steam as stripping medium such as methane or other gases, may also be used.

Further alternative destinations of the overhead vapour from the stripper may include any position upstream the fractionation section including the inlet to the process heater 10.

To optimise the yield further it is also possible to withdraw HPNA by adsorption on a bed of activated carbon, or another absorbent, as it is disclosed in U.S. Pat. No. 4,447,315. Such a bed will work especially well in the case of a high concentration HPNA purge stream, since the size of the bed may be smaller. Operation may involve operating two parallel beds alternating, such that one bed may be regenerated or replaced without interrupting plant operation.

EXAMPLES

Example 1

In order to test the potential split of HPNA in the proposed invention, a sample of hydrocracked unconverted oil obtained from a commercially operating hydrocracking plant with the properties shown in Table 1 was distilled in an ASTM D-1160 apparatus. Since this apparatus does not utilize reflux it generates a physical separation with substantial overlap between the overhead and bottoms product and corresponds well to the vapour/liquid separation in a simple steam stripper.

TABLE 1

| Properties of Unconverted Oil Sample | | |
|---|---|---|
| Specific Gravity | | 0.844 |
| Heavy Poly-Nuclear Aromatics | | |
| Coronene | wtppm | 394 |
| 1-MethylCoronene | wtppm | 132 |
| NaphCoronene | wtppm | 127 |
| Ovalene | wtppm | 91 |
| Total HPNA | wtppm | 744 |
| Distillation | | |
| Initial Boiling Point | ° C. | 342 |
| 10% | ° C. | 397 |
| 50% | ° C. | 451 |
| 90% | ° C. | 513 |
| Final Boiling Point | ° C. | 572 |

Two laboratory distillations were performed using the ASTM D-1160 method and apparatus, the first yielding a bottoms fraction of 50 volume percent of the initial charge and a second yielding a bottoms fraction of only 20 volume percent of the charge, to document how the HPNA would partition in the overhead and bottoms fractions. The results of HPNA analysis and distillation analysis on both the bottom fraction and the overhead vapour fractions are summarized in Table 2.

TABLE 2

Properties of Distilled Fractions

| | | Case Fraction | | | |
|---|---|---|---|---|---|
| | | I | | II | |
| | | Bottoms | Distillate | Bottoms | Distillate |
| Yield | % vol. | 50 | 50 | 20 | 80 |
| Specific Gravity | | 0.849 | 0.838 | 0.855 | 0.840 |
| Heavy Poly-Nuclear Aromatics | | | | | |
| Coronene | wtppm | 650 | 105 | 775 | 245 |
| 1-MethylCoronene | wtppm | 240 | 20 | 385 | 55 |
| NaphCoronene | wtppm | 235 | <5 | 565 | <5 |
| Ovalene | wtppm | 175 | <5 | 475 | <5 |
| Total HPNA | wtppm | 1300 | 130 | 2200 | 305 |
| Initial Boiling Point | ° C. | 406 | 288 | 440 | 338 |
| 10% | ° C. | 439 | 380 | 473 | 391 |
| 50% | ° C. | 479 | 426 | 510 | 441 |
| 90% | ° C. | 531 | 463 | 550 | 483 |
| Final Boiling Point | ° C. | 583 | 511 | 596 | 529 |

These results clearly show that the ASTM distillation has achieved a substantial separation of HPNA between the overhead distillate and bottoms fraction. This is a consequence of the very low volatility of the HPNA compounds. In a hydrocracker, it is necessary to purge sufficient HPNA from the system to balance the net production of HPNA by reaction. In this example, Case I results in an increase of the total HPNA concentration by a factor of from 744 ppmwt to 1300 ppmwt or 175 percent. Case II results in an increase of total HPNA by a factor of from 744 ppmwt to 2200 ppmwt or 295 percent.

Example 2

Performance of the invention was evaluated based on a steam stripper under the conditions shown in Table 3 below.

TABLE 3

Process Conditions for Steam Stripping Column

| | | |
|---|---|---|
| Theoretical Trays | | 4 |
| Stripping Steam Rate (22) | kg/hr | 3243 |
| Column Top Pressure | barg | 1.30 |
| Column Bottom Pressure | barg | 1.36 |

Process experiments were performed at two different stripper feed temperatures, 350° C. and 380° C. to illustrate the split of overhead vapour and bottoms liquid products. Coronene HPNA molecule was also included in the experiment to show how the vapour-liquid equilibria would predict the distribution of the lightest HPNA species. The results based on 350° C. stripper feed temperature are presented in Table 4 below. At this feed temperature, 50 weight percent is distilled overhead and 50 percent is recovered in the bottoms liquid product. The coronene component has been concentrated in the stripper bottoms from 461 ppmwt in the feed to by 691 ppmwt in the bottoms corresponding to 150 percent.

TABLE 4

Stripper Feed and Product Rates and Properties

| | | Stream Description | | |
|---|---|---|---|---|
| Stream No. | | Stream for stripping 20 | Stripped liquid 24 | Overhead vapour 23 |
| Stream Temperature | ° C. | 350 | 209 | 312 |
| Yield (% of Feed) | % wt. | 100 | 50 | 50 |
| Heavy Poly-Nuclear Aromatics | | | | |
| Coronene | Wt ppm | 461 | 691 | 231 |
| Distillation | | | | |
| IBP | ° C. | 300 | 340 | 282 |
| 10% | ° C. | 360 | 393 | 344 |
| 50% | ° C. | 427 | 447 | 407 |
| 90% | ° C. | 483 | 505 | 455 |
| FBP | ° C. | 560 | 563 | 511 |

The stripper results based on 380° C. stripper feed temperature are presented in Table 5 below. At this feed temperature, 64 weight percent is distilled overhead and 36 percent is recovered in the bottoms liquid product. The coronene component has been concentrated in the stripper bottoms from 466 ppmwt in the feed to 727 ppmwt in the bottoms corresponding to 156 percent. Most of the HPNA molecules of concern in hydrocracker are in fact heavier and less volatile than coronene and can be expected to further concentrate in the stripper bottoms stream.

TABLE 5

Stripper Feed and Product Rates and Properties

| | | Stream Description | | |
|---|---|---|---|---|
| Stream No. | | Stream for stripping 20 | Stripped liquid 24 | Overhead vapour 23 |
| Stream Temperature | | 380 | 195 | 325 |
| Yield (% of Feed) | % wt. | 100 | 36 | 64 |
| Heavy Poly-Nuclear Aromatics | | | | |
| Coronene | Wt ppm | 466 | 727 | 319 |
| Distillation | | | | |
| IBP | ° C. | 300 | 346 | 288 |
| 10% | ° C. | 360 | 398 | 350 |
| 50% | ° C. | 427 | 454 | 414 |
| 90% | ° C. | 483 | 515 | 462 |
| FBP | ° C. | 560 | 554 | 524 |

Example 3

The performance of an embodiment based on recycling the stripper bottoms in the same quantity as the feed stream and heating to the same temperature of 350° C. is shown in Table 6. A comparison of the distillation curve of the net purge stream 24 in Table 4 and Table 6 shows that with recycle of a part of the stripper output, the amount of high boiling products in the net purge is increased, i.e. the temperature of the highest boiling 10% is increased from 505° C. to 527° C. At this higher degree of concentration, it can be seen in Table 6 that the concentration of coronene in the overhead vapour 23 is only slightly below that of the heavy bottoms fraction 15, which indicates a large portion of this HPNA tracer has volatilized into the overhead vapour fraction. However, other HPNA compounds that are heavier and higher boiling than coronene would predominantly be concentrated in the heavy bottoms fraction and be purged from the system.

TABLE 6

Stripper Feed and Product Rates and Properties
Alternate Bottoms Recycle Configuration

| Stream No. | | Stream Description: Stream for stripping 20 | Stripper recycle 27 | Stripped liquid 24 | Overhead vapour 23 |
|---|---|---|---|---|---|
| Stream Temperature | ° C. | 350 | 350 | 254 | 326 |
| Yield (% of Feed) | % wt. | 100 | 100 | 20 | 80 |
| Heavy Poly-Nuclear Aromatics | | | | | |
| Coronene | Wt ppm | 470 | 720 | 720 | 408 |
| Distillation | | | | | |
| IBP | ° C. | 301 | 376 | 376 | 295 |
| 10% | ° C. | 361 | 415 | 415 | 355 |
| 50% | ° C. | 428 | 472 | 472 | 419 |
| 90% | ° C. | 484 | 527 | 527 | 465 |
| FBP | ° C. | 527 | 554 | 554 | 488 |

These results demonstrate that under reasonable and practical conditions of temperature, pressure and flow rate, the unconverted oil stream can be split by steam stripping and result in the concentration of HPNA compounds in a bottoms liquid stream. This concentration will lead to decreased net purge rates from the hydrocracker and corresponding increased conversion and yields of distillate products.

An example of the conversion improvement comparing a case with net purge equal to three volume percent of the hydrocarbonaceous feed to a case with net purge equal to 0.6 volume percent of hydrocarbonaceous feed is shown in Table 7. The production of naphtha, kerosene, and diesel increased from 107.45 to 109.84 volume percent of hydrocarbonaceous feed.

TABLE 7

Yield Improvement due to stripping of purge

| Yields in volume % of feed | Without stripping of purge | With stripped net purge |
|---|---|---|
| Naphtha | 23.42 | 23.94 |
| Kerosene | 54.42 | 55.63 |
| Diesel | 29.61 | 30.27 |
| Net Unconverted oil purge | 3.0 | 0.60 |
| Naphtha + kerosene + diesel | 107.45 | 109.84 |

The invention claimed is:

1. A hydrocracking process comprising the steps of:

(a) combining a hydrocarbonaceous feedstock and a heavy bottom fraction recycle stream with a hydrogen-rich gas to obtain a mixture comprising hydrocarbonaceous feedstock and hydrogen;

(b) catalytically hydrocracking the mixture comprising hydrocarbonaceous feedstock and hydrogen in a hydrocracking zone to obtain a hydrocracked effluent;

(c) separating the hydrocracked effluent into a first vapour portion and a first liquid portion in a separation zone;

(d) heating the first liquid portion to form a vapourised first liquid portion;

(e) feeding and introducing the vapourised first liquid portion to a fractionation feed section of a fractionator having an upper light fraction zone and a bottom, heavy fraction discharge zone, fractionating the vapourised first liquid portion and producing individual product fractions including a light fraction and a heavy bottom fraction comprising unconverted oil at the bottom discharge zone;

(f) withdrawing the heavy bottom fraction from the bottom discharge zone at a point below the feed and introduction section;

(g) splitting the withdrawn heavy bottom fraction from the bottom discharge zone into a stream for stripping and a heavy bottom fraction recycle stream comprising HPNA, and recycling the heavy bottom fraction recycle stream comprising HPNA to form a portion of the mixture of step (a);

(h) directing, as a first stream, the stream for stripping, as a second stream, a stripping medium, and , as an optional third stream, a recycled portion of a stripped liquid, to a counter current stripping column and withdrawing from said stripping column an overhead vapour and the stripped liquid;

(i) feeding the overhead vapour to the fractionation section, to the heavy bottom fraction recycle stream or to a position upstream the fractionation section; and (j) removing at least a part of the stripped liquid from the counter current stripping column as a net purge of unconverted oil, and (k) transferring thermal energy to one of said first stream, second stream and optional third stream prior to directing said stream to the counter current stripping column.

2. Process according to claim 1, wherein the vaporised first liquid portion is at least 50% vaporised.

3. Process according to claim 2, wherein some or all of the energy for the heating of the stream for stripping is provided by heat exchange with one or more streams from the hydrocracking process.

4. Process according to claim 1, wherein a part of the stripped liquid is recycled, combined with the stream for stripping and directed to an inlet of the counter current stripping column.

5. Process according to claim 4, wherein the recycled portion of the stripped liquid and/or the stream for stripping is heated by heat exchange with the heavy bottom fraction.

6. Process according to claim 1, wherein the stream for stripping is heated prior to the stripping process to raise its temperature above its bubble point.

7. Process according to claim 1, wherein the stripping medium is steam having a pressure between 1 and 20 barg.

8. Process according to claim 1, wherein the counter current stripping column comprises multiple equilibrium stages in the form of trays or packing material.

9. Process according to claim 1, wherein a flow rate of the stream for stripping is controlled by a flow control unit according to a desired flow rate of the net purge of unconverted oil.

10. Process according to claim 1, wherein the hydrocarbonaceous feedstock is hydrotreated prior to hydrocracking.

11. Process according to claim 1, wherein the heating of the stream for stripping is provided from one or more heat sources selected from the group consisting of a reactor effluent, an external source of heating medium, high pressure steam, hot flue gas from a fired heater, and electrical heating.

12. Process according to claim 1, wherein stripping medium output from the stripping unit is added to the fractionation column.

13. Process according to claim 1, wherein HPNA is extracted from the net purge by adsorption on an adsorbent.

* * * * *